United States Patent [19]

Foster

[11] 4,146,230

[45] Mar. 27, 1979

[54] ELECTRONIC GOLF TRAINER WITH GOLF CLUB HEAD SELECTION

[76] Inventor: David B. Foster, White House, Sunninghill Rd., Windlesham, Surrey, England

[21] Appl. No.: 806,588

[22] Filed: Jun. 15, 1977

[30] Foreign Application Priority Data

Jun. 21, 1976 [GB] United Kingdom ..... 25731/76

[51] Int. Cl.[2] ..... A63B 69/36

[52] U.S. Cl. ..... 273/186 R; 273/183 R

[58] Field of Search ..... 35/29 R; 273/183 R, 273/184 R, 185 R, 186 R, 186 RA, 181 H; 73/379; 235/92 GA; 340/323 R; 364/410, 411

[56] References Cited

U.S. PATENT DOCUMENTS

| | | | |
|---|---|---|---|
| 2,571,974 | 10/1951 | Walker | 273/186 R A |
| 3,598,976 | 8/1971 | Russell et al. | 273/183 R X |
| 3,601,408 | 8/1971 | Wright | 273/186 R |
| 3,759,528 | 9/1973 | Christophers et al. | 273/185 R X |

*Primary Examiner*—Vance Y. Hum

[57] ABSTRACT

The present invention concerns golf teaching apparatus in which a student swings a golf club over a target area having photocells. The outputs from the photocells are analyzed and displayed to give an indication of yardage and faults in the student's swing. Club type is selectable and entered into the apparatus for influencing the analysis.

6 Claims, 5 Drawing Figures

1
2
5a
5b
38
39
40
41
42
43
44
45
46
47
48
49
50
51
52
53
54
55
R
114
115
116
117
3
4
98
99
100
110
112
6a
7a
101
102
103
6b
7b
104
105
106
111
113
109
107
108
95
94
93
92
89
88
87
91
90
60
86
33
31
57
23
21
62
63
64
65
66
67
68
69
70
71
72
73
74
76
77
78
20
14
8
56
58
59
61
120
125
126
127
34
118
119
121
122
123
124

ELECTRONIC GOLF TRAINER WITH GOLF CLUB HEAD SELECTION

BACKGROUND OF THE INVENTION

The present invention relates to apparatus for training golf players (hereinafter referred to as "trainees")

SUMMARY OF THE INVENTION

The invention may be considered to consist in apparatus that includes a photo-electric system in which the swing of a golf club by a trainee at a ball creates a moving shadow in an impact zone in conjunction with an overhead projector lamp, said shadow being caused to fall in any array of photo switches located beneath an apertured mat located under the ball, the state of darkened and illuminated photo switches creating data which is subjected to electric processing to effect a display of the direction of the club head at the moment of its impact with the ball. The display thus gives information such as to "hooking" or "slicing" of the ball.

The ball may be a real or simulated golf ball.

Advantageously the system is arranged to measure the speed of the club head and/or it may display the calculated distance that the ball would have travelled to, these parameters being settable to relate to any of the normal complement of golf clubs. The settings for a given club type may be selected against the weight of the club head or its swing weight or indeed any other characteristic which can change the relationship between club head speed and distance of ball travel. This feature is useful in assisting a trainee to determine his choice of club type as to, for example, club head weight, swing weight, shaft stiffness and so on.

The system advantageously employs a triangulated arrangement of photo switches related to the club face at the sole line and this triangulation arrangement may be multiplicated so as to select which of the triangulated arrangements is closest to the centre of the club face at impact.

Numerical counters may be utilized to display some of the data e.g. degree of "hooking" or "slicing".

The system may be reset by the shadow from the club during the back swing, by operating a further photo switch. In this connection, the projector system may include a simple light bulb and a lens and a mirror to create two light beams falling in the different areas, to operate the "main" and "reset" photo switches respectively. The display is advantageously suppressed during the trainee's swing.

It will thus be clear that the invention is concerned with giving a trainee golfer or his teacher information about the quality of the impact of golf club with golf ball and answers to the following questions:

1. Was the ball impacted centrally or off-centre as the striking club face?
2. What distance would the ball have travelled relative to the appropriatness of the club being used?
3. Was the club face "square" to the ball at impact or was it "open" or "shut"?
4. Did the club head come into the ball in a strike direction normal to the ball face or did the club come in from out-to-in to create a slice or from in-to-out to create a hook?

Other features and advantages will become apparent by a perusal of the following description taken in conjunction with the accompanying drawings which show certain embodiments and circuit arrangements for use thereby by way of example and in which:

DETAILED DESCRIPTION OF PREFERRED EMBODIMENT

Figure 1:
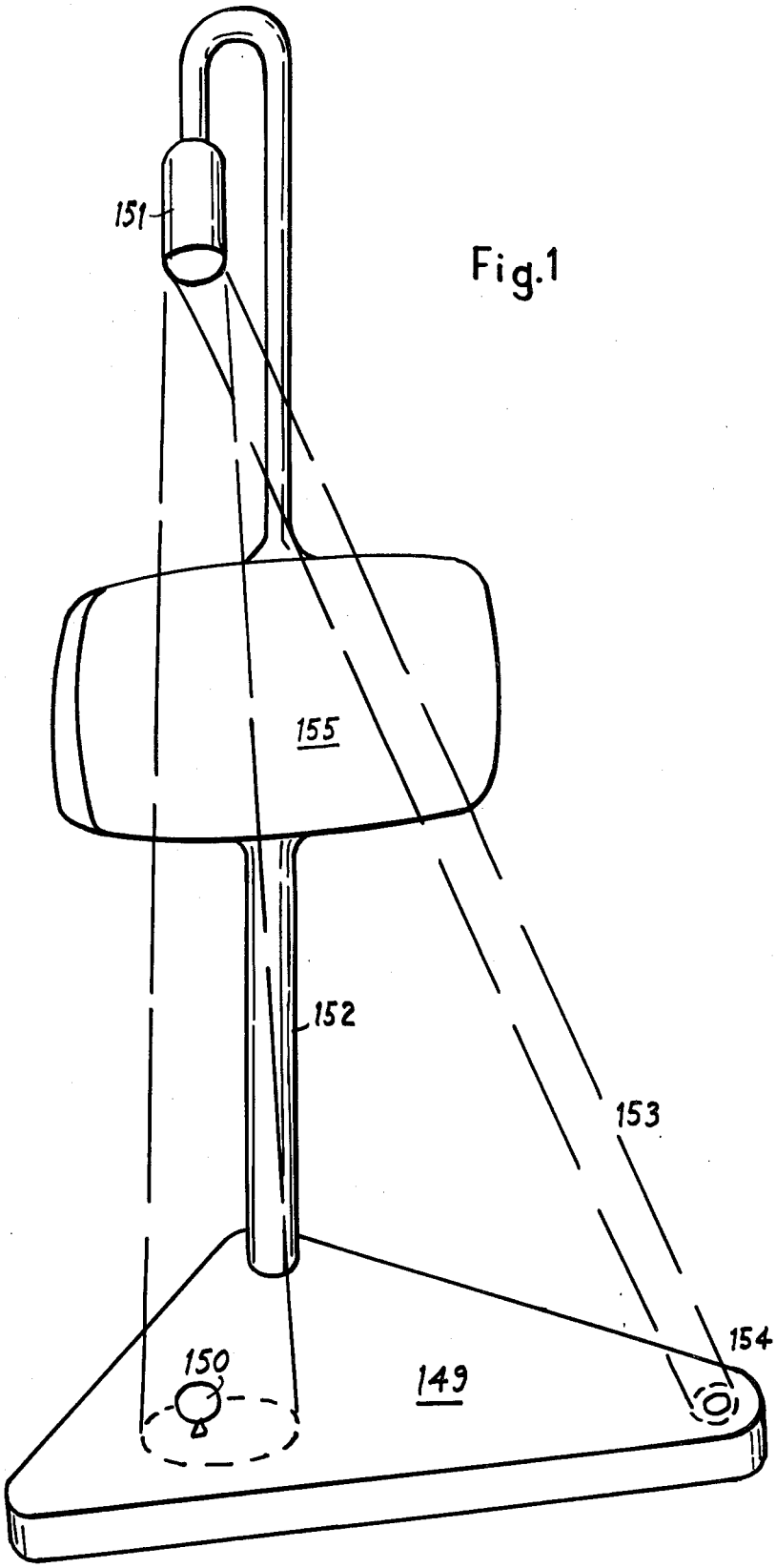
FIG. 1 schematically shows one embodiment of the mechanical aspect of the apparatus.

Referring now to the drawings, the physical form of the mechanical parts of the system is shown in FIG. 1 and consists of a strike mat 149 on which the ball 150 is placed in an accurate and specific location. A stand 152 leads to a projector lamp 151 consisting of a lamp and condenser lens and this throws a beam down to the ball and creates a sharp shadow of the golf club head used to strike the ball. Under the strike mat in this illuminated zone is an array of photo switches and apertures in the strike mat (not shown in this Figure) which allow the light to penetrate to them. The ball 150 may be a real golf ball but, particularly if the apparatus is set up inside, may be a simulated golf ball such as a light weight plastics ball.

The lamp 151 has within it a mirror at the side and causes a secondary beam 153 to shine into a photo switch 154 whose purpose is to reset the system during the golfer's backswing and related to a shadow thrown by the club shaft during that backswing.

Mounted on the stand 152 at a convenient height for viewing is a display 155 which reveals the data processed related to the logical deductions from the state of the photo switches in the main beam of the lamp.

Figure 3:
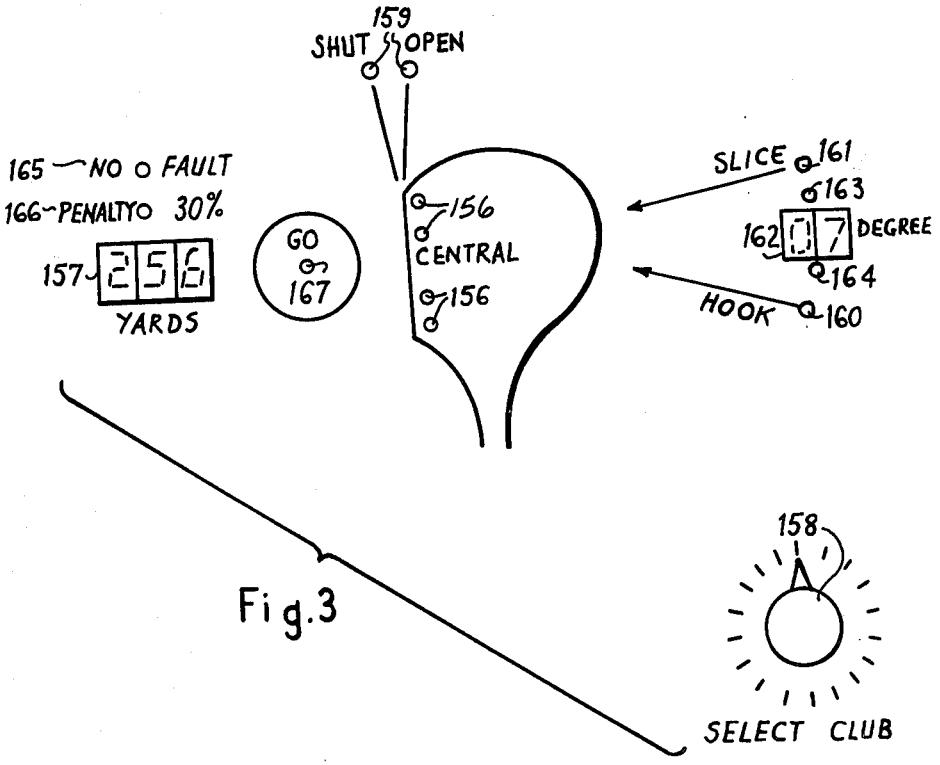
FIG. 3 shows an embodiment of the electrically-actuated display.

Referring to FIG. 3 the display has the following main features:

(a) at 156 lamps light showing where the ball was impacted by the club related to centrality or departure therefrom.

(b) at 157 there is a digital display of the distance in any desired units the ball would have travelled after impact.

(c) at 158 there is a selection switch which is set to the particular type of club in use by the golfer.

(d) at 159 is a pair of lamps which alternately light if the club face was shut or open, there being no lighted lamps if the face was correctly within present limits.

(e) at 160 and 161 are lamps which alternatively light if the direction of the club was such as to exceed predetermined limits as to hooking and slicing respectively.

(f) at 162 is a digital display showing the number of specific degrees as to slicing or hooking and a lamp 163 indicates a slice and a lamp 164 indicates alternatively a hook.

(g) at 165 a lamp lights if there has been no excess of faults as regards the above features.

(h) at 166 a lamp lights to indicate that a fault has been incurred and that the displayed digital distance has been deducted by an amount of about 30 percent.

(i) at 167 a lamp lights indicating that the system is ready for the golfers stroke and carries the legend GO.

Referring back to FIG. 2;

(i) Photoswitch (1) collaborates with photo switch (2) to open an electronic gate system related to club speed.

(ii) Photo switches (21) (23) (31) and (33) are activated by the passing shadow of the club tip and give data which is logically processed to determine the centrality of the ball with the club face or departures thereof.

(iii) Thirteen photo switches (8) to (20) inclusive form Array A and

Thirteen photo switches (21) to (33) inclusive form Array B and the logical data from the passing club tip shadow is used to determine the degree of hooking, slicing or correct straightness of impact direction.

(iv) Photo switches (2) (3) (4) combine to create data related as to whether the club face was open or shut.

(v) Photo switches (5*a*) (6*a*) and (7*a*) combine to create data as to whether the club face was open or shut and when the ball is impacted towards the toe of the club.

(vi) Photo switches (5*b*) (6*b*) and 7*b*) combine to create data as to whether the club face was open or shut and when the ball is impacted towards the heel of the club.

The term 'photo switch' is used to describe two-state photo-electric devices available on the commercial market. But it can be used generally to refer to photocells of appropriate speed and with a following amplifier or device which effectively permits it to be used in a two-state system.

Measurement of Club Speed and Ball Travel (Yardage)

Figure 4:
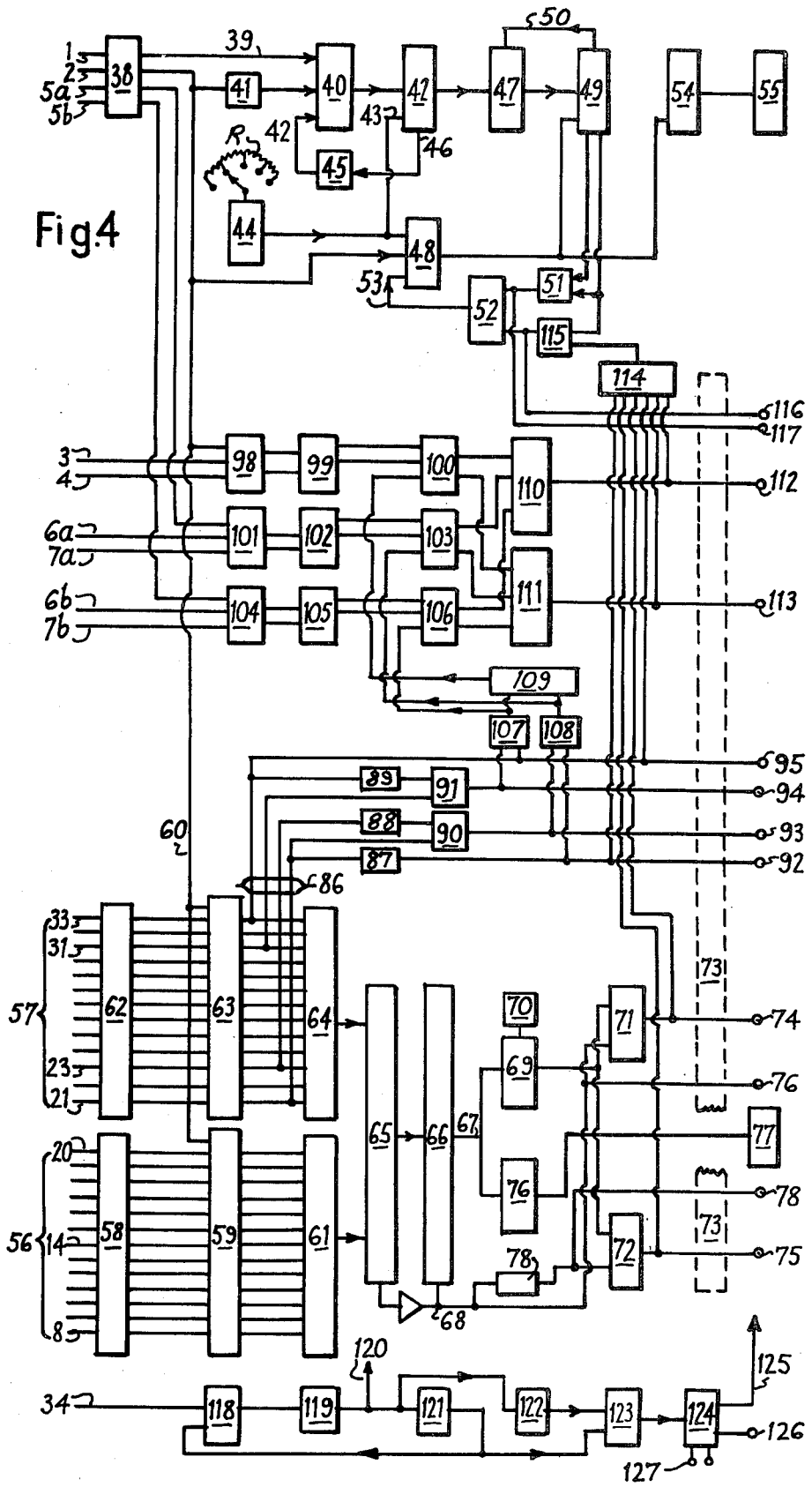
FIGS. 4 and 5 show some of the circuit arrangements of the logic circuits and display operators.

Reference FIG. 4. The photo switch (1) is typically located 4 inches behind a second photo switch (2) both being approximately in the ideal centre line of stroke and with the club head shadow first falling over switch (1) and then over switch (2). The shadowed output of the photo switch (1) passes to a latch system (39) whose output (39) is arranged to give a logical '1' which is presented to the input of a 3-AND gate (40). For the period during which the club-head shadow has not reached photo switch (2) the latter's latch (38) is in the '0' output state and this is reversed to '1' by the inverter (41). Thus in this phase there are logical '1's coming from both photoswitches (1) and (2) and this opens the 3-AND gate (40). The third input to this gate (42) is normally in the '1' state and thus does not interfere with the opening of the gate and the function of the third input will be described later. The opening of the gate (40) activates an enable signal to a three decade counter (42) which is also supplied with clock pulses at its input (43) emanating from an electronic clock (44) whose rate is of the order of 100KC/sec. Such pulses register progressively in the counter until the second photo switch (2) goes into the dark state and produces a logical '0' at the 3-AND gate (40) which closes and withdraws the enable signal to the counter (42) which thus stops counting. The capacity of the counter is so arranged that the number of incoming pulses will not normally fill it to capacity but to guard against this possibility which would cause it to recycle and produce spurious numbers it is stopped at full count. This is done by extracting its last digit 2048 at (46) and inverting at (45) whence it presents (42) a logical '0' to the 3-AND gate (40) and thus disables the counter and stops it in the full state.

The number registered in the counter (42) provides the constant input to an adder (47) of four-decade capacity. When the second photo switch (2) goes dark and the count is stopped it also provides a logical '1' to the 3-AND gate (48) which is also fed from the clock (44). This opens the gate since the third output is normally at '1' and the clock pulses pass through the gate to a synchronous register (49) which is connected to the output of the adder. At each clock pulse the register passes the number it contains back to the adder (50) which adds this number to its original number from the counter. Thus at any time there is an output on the regiter (49) which is equal to N × P where N is the constant number from the counter and P is the number of times the register has been clocked.

The register (49) has sixteen digits the two highest corresponding to the decimal numbers 16384 and 32768 respectively their sum being 49152 and the two corresponding '1' binary digits are logically combined in the 2-AND gate (51) whose output is thus activated corresponding to the decimal number 49152.

The output signal '1' goes via a 2-NOR gate (52) becoming '0' to the input (53) of the 3-AND gate (48) which is thus closed and stops further clocking of the register which is thus halted at the equivalent decimal number 49152. During this operation of clocking the register the clock pulses are also taken to a second counter (54) and thereafter decoded to drive a three-digit numerical display such as an LED display at (55).

This number can represent the speed of the gold head in feet per second as follows:

Let
V be the speed of the club head in ft. sec. which is to be the same as numerically displayed.
D be the distance apart of the two photo switches
T be the transit time over distance D
C be the clock rate in pulses per second
N be the decimal number in the stopped register
Q be the number of clock pulses into the first counter From the display:

$$V = N/Q \quad (1)$$

But from physical fact:

$$V = D/T$$

But:

$$T = Q/C$$

so $$V = DC/Q \quad (2)$$

Combining (1) and (2):

$$N/Q = DC/Q$$

$$\therefore C = N/D$$

Thus if D is 1/3rd foot and N is 49152

C (clock rate) 32 49152 × 3 = 147,456 per second.

To display golf travel e.g. in yards and herein referred to as "yardage", instead of feet per second we need to known from the golf art what is the yardage-speed correlation as a factor K. This factor for a No. 1 Wood is usually given as 0.62 in that if a club moves at 62 feet per second then the ball will travel 100 yards. This factor is constant for practical purposes over the whole speed range for a given club and this is due to the fact that the kinetic energy in the club is proportional to the square of its speed whilst the aerodynamic resistance in the ball is also proportional to the square of ball speed. Thus the two 'squares' cancel out and one is left with a linear relationship. Thus the factor for determining clock speed is:

$$C = KN/D$$

and in the example given above:

$$C = 147{,}456K$$

Using the value K = 0.62 for the No. 1 Wood, then the clock rate formula for the No. 1 Wood is:

$$C = 0.62 \times 147{,}456 = 91{,}500 \text{ cycles per second}$$

But the factor K is known for all golf clubs of standard weight and thus we know the correct clock rate for all standard clubs. Thus the clock (44) is chosen to be of the type which can easily be externally adjusted as to its rate by means of a variable resistance system (R) and this can be a rotary switch whose dial is marked against different club types and which select the correct resistors to control the clock-rate appropriately. A typical clock device for such purposes is the 555 device made by Signetics Inc. This device could be equivalently controlled by capacitor selection since its rate depends upon an RC circuit.

Measurement of Golf Yardage for Variations within a Nominal Club Type

The empirical constant K (say for a No. 1 Wood) is derived from tests involving professional golfers and using standard golf clubs whose typical head weight for a given club (such as the No. 1 Wood) is eight ounces.

But a given type of golf club is supplied in a different number of head weights and for a given club speed, which is what the system described actually measures, the yardage will be greater for heavier than lighter club heads and relating to the kinetic energy of the club head as $\frac{1}{2}mv^2$, where m is the mass and v is the velocity. However, due to the fact that the ball yardage is linearaly proportional to club speed as described earlier then the effect of the empirical constant K due to variable club head weight is:

$$K_1 = K\sqrt{m}$$

where $K_1$ is the empirical constant allowing for variation of club head mass

K is the empirical constant using a standard club-head mass such as 8 ounces m is the relative mass of the actual club being used.

This leads to a system of nominal setting of the system in terms of club head weights (or alternatively the so-called 'swing weights' in the golfing art) whereby for a given club there is a number of clock speed settings on a selectable rotary switch or the like but which basically correspond to variations of the co-efficient K as related to $\sqrt{m}$. Thus, for example as applied to the No. 1 Wood the following could apply:

| Marking of Selection Switch | Relative K and Relative Clock Speed |
|---|---|
| No. 1 Wood 10 oz. | .895 |
| No. 1 Wood 9 oz. | .945 |
| No. 1 Wood 8 oz. | = |
| No. 1 Wood 7 oz. | 1.07 |
| No. 1 Wood 6 oz. | 1.155 |

-continued

| Marking of Selection Switch | Relative K and Relative Clock Speed |
|---|---|
| No. 1 Wood 5 oz. | 1.27 |

The practical advantage of such a system is that it enables a golfer to try out various head weights of a given club type (such as the No. 1 Wood) and by setting into a rotary switch or the like the head weight (or the 'swing weight') to find whether such club is to his advantage as to the maximum yardage to which he can strike the ball. Such a system could be the basis of a fundamentally correct way of evaluating clubs of different head weights and other characteristics prior to the purchase of golf clubs.

Such a method can be extended towards the trial of other clubs that the No. 1 Wood typified above.

Club Strike Direction—Hooking and Slicing

Figure 2:
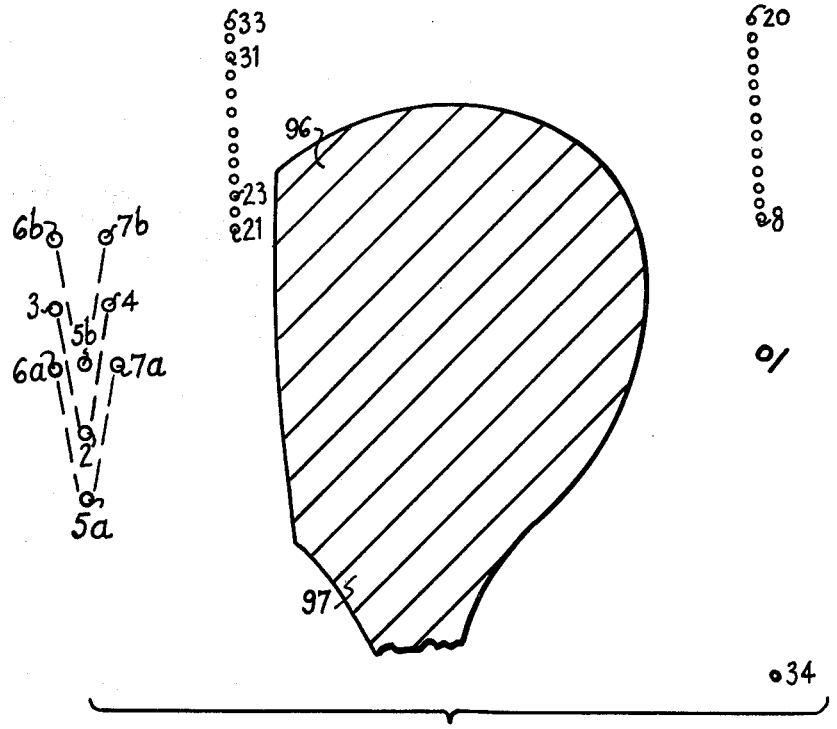
FIG. 2 shows a plan view of the photo switch array and a section through a golf club head.

It is well established in the golfing art that if the golfer strikes the ball in a direction of club motion which is not along the line which joins the centre of the ball to the point where it is impacted, then if the strike comes inwards towards the ball it will impart clockwise spin to the ball as seen from above which will curl off to the right as a slice. If the ball is struck from inwards to outwards the ball will spin in an anti-clockwise direction and the ball will curl to the left as a hook. In order to determine this effect there are employed two arrays of photo switches as shown in FIGS. 2 and 4. Array A (56) consists of thirteen (for example) photo switches located across and at right angles to the path of the passing clubhead shadow and spaced one tenth inch apart and so that when the club has the ideal central line of flight the tip shadow would approximately coincide with the central cell (14).

Some six inches in front of this Array A and towards the ball is a second Array B (57) also consisting of, say, thirteen photo switches. The nature of the system is therefore such that if the same number of photoswitches in each Array is darkened by the passing club shadow then the strike is in the correct direction being neither "in to out" nor "out to in". But if more photo switches are darkened in Array A than Array B then the strike is "out to in" to cause a slice whilst if more photo switches are darkened in Array B than Array B then the strike is from "in to out" or a hook. The extent of the difference as between the number of photo switches darkened in Array A and Array B is the extent of the slice or hook.

If the photo switches are preferentially arranged with one tenth of an inch separating those in a given array and if the two arrays are separated by six inches, then the angle represented by a difference of one photo switch in the two arrays will be one degree. This is preferential since, as we shall later use, it enables a numerical display of hook and slice effects in increments of one degree.

Referring now to FIG. 4, array A is defined by the photo switches (8) to (20) whilst array B is defined by photo switches (21) to (33). The photo switches in array A are taken to individual latches in the bank (58) and their outputs go to a register of flip-flops (59) which is clocked into operation to set the flip-flop outputs by the line (60) coming from the latch bank (38) and set by photo switch (2). From FIG. 4 it will be noted that photo switch (2), which is the one which marks the end of club speed determination as described earlier, is set further towards the ball along the strike direction then array B and this is to ensure that all the latches in array B have been set before this moment in that the extreme tip of the club-head has already passed them by.

The output of the flip-flop register relating to array A is then taken to an encoding unit (61) (such as the Texas Unit 74147) which has the effect of converting the signals on the output of the flip-flop register which correspond to darkened photoswitches into a binary coded decimal (BCD) number.

Exactly the same occurs relates to array B in that the thirteen photo switches (21) to (23) go into a latch bank (62) and then into a flip-flop register (63) also set by photo switch (2) via line 60. The output of the flip-flop register is converted to BCD code in the encoder (64).

The operational result is that at the output of the encoder (61) we have a BCD number corresponding to the number of photo switches which have been darkened in array A whilst at the output of encoder (64) we have a BCD number corresponding to the number of photo switches which have been darkened in array B. Thus the degree of hook or slice depends upon the difference between these two numbers.

The two outputs from (61) and (64) are taken to a sign-and-magnitude generator (65) and (66) of the type such as 82S82 described in the Signetics application manual and at the output of which (67) is the numerical difference in BCD code as between the two encoders (61) and (64) and which also has an output signal (68) which is the sign and informs whether the number from array A was the greater or less than from array B.

The output of the magnitude generator, the difference number, is taken to a digital comparator (69) such as the Texas 7485 units for comparison with a hard-wired number (70) which represents the permissible limit before a hook or slice is declared to be 'fault'. If the input from the magnitude generator (67) is a number greater than that of the comparison number (70) then a 'greater than' signal is produced by the comparator. This signal is taken to two 2-AND gates (71) and (72) which are alternatively enabled by the sign signal (68), and its reversed signal in the inverter (78), the upper gate (71) corresponding to a slice and the lower gate (72) corresponding to a hook.

The corresponding output signal is taken via one of a bank of open collector inverters (73) to activate either the light emitting display diode (74) at to 'slice' or (75) as to 'hook' which lamps are preferably of red colour.

This completes the description of the hook-slice circuitry inasmuch as the ultimate display is of a two-state nature as to fault or no-fault.

Reverting back to the point (67) where we have the differential count in BCD code, this is taken to a BCD drive unit (76) such as Texas 7447 units which in turn drives a two-decade numerical light-emitting diode display at (77). This thus displays the numerical magnitude of the hook or slice and preferably in degrees according to the preferred photo switch spacings described earlier. The signals from the sign device (68) associated with the sign-and-magnitude generator (65 and 66) and which have already been used for opening the fault gates are also taken directly through open-collector inverters (73) to illuminate one of two alternative and preferably yellow light emitting diodes (76) and (78) and these are placed adjacent to the numerical display (77) to indicate whether the numbers shown refer to a hook or slice in the event that the lamps (74) and (75) are not illuminated because below the 'fault' level.

It will be appreciated that the circuitry represented in FIG. 4 by (64), (61), (65), (66), (69), (76) could be realised by complex combination logic but this would become highly cumbersome with the large number of photo switches such as the twenty-six involved to give the fine discrimination desirable.

The purpose of such a high number of photo switches is to ensure an accurate result as to hook and slice irrespective of the absolute average position of the club normal to the strike direction. Thus, for example, if there are 7 darkened photo switches in array A and 3 in array B giving a difference of 4, the clubhead being somewhat inboard to the golfer, the same declared result would occur if there had been 12 darkened photo switches in array A and 8 in array B, the same difference of four and which is a situation in which the clubhead is moving somewhat outboard from the golfer. In this fashion the declaration of hook or slice and its magnitude is kept independent of other variables.

Club Face and Ball Relationship

It is well established in the golfing art that the centrality of the ball on the club-face at impact is vital to secure maximum yardage and straightness and in book "The Search for the Perfect Swing" by Cochran and Stobbs they show that there is the following loss of distance:

| Distance of Ball Club from Centrality | Loss of distance |
|---|---|
| .25 inches | 1.5 percent |
| .50 inches | 6.0 percent |
| .75 inches | 15.0 percent |

In this system certain photo switches in array B are used as shown in FIG. 4, and as to (21), (23), (31), (33). Using the 0.10 inch spacing referred for array B, the above establish zones are as follows:

| Photo switches | Distance from Centrality |
|---|---|
| (23) | .4 inches and less towards toe |
| (23) and (21) | .4 inches to .6 inches towards toe |
| (21) | .6 inches and beyond towards toe |
| (31) | .4 inches and less towards heel |
| (31) and (33) | .4 inches to .6 inches towards heel |
| (33) | .6 inches and beyond towards heel |

The first three relate to an inboard displacement of the club head or what is called 'toe' hitting whilst the last three relate to an outboard displacement of the clubhead or what is known as 'heel' hitting. It is considered that to hit the ball over 0.6 inches from centrality would involve a minimum loss of 10 percent of yardage and thus must be accounted a 'Fault'. Whilst to hit the ball between 0.4 and 0.6 inches off centrality will involve a 6 percent loss of yardage and should be considered as a Warning Zone.

The four photo switches (21), (23), (31) and (33) have already been the subject of latching into the latch bank (62) and the flip-flop register (63) set by photo switch (2) at by time (60) into the register. The corresponding outputs of the register (63) are tapped at (86) are are taken into a combination logic system consisting of the three inverters (87), (88), (89) and the 2-AND gates (90) and (91). The result is four outputs which go via the open collector inverter (73) to four light emitting diodes at (92), (93), (94) and (95) and which denote:

(92) —Red lamp —the ball was struck over 0.6 inches off centrality towards the toe of the club.

(93) —Yellow lamp —the ball was truck between 0.4 and 0.6 inches off centrality towards the toe of the club.

(94) —Yellow lamp—The ball was truck between 0.4 and 0.6 inches towards the heel of the club

(95) —Red lamp—The ball was truck over 0.6 inches from centrality towards the heel of the club.

The lamps are arranged on an appropriate diagram of the golf club as shown in FIG. 3 at (156). Thus the golfer can see at a glance the zone of the club where he impacted the ball.

Since there are (say) thirteen photo switches in array B then each of these could be used to operate into the sort of counting technique and numerical display as used for the hook-slice system and could indicate the position of the ball on the club face to the nearest one tenth of an inch. However, the golfing art informs that such fine limit discrimination is not of practical utility.

Club Face Squareness

By Newton's Second Law of Motion an impacted body will move in the direction of the impacting force. As applied to golf this means that if the clubhead face is normal or square to the intended direction line, then the impacted ball will move in that direction. If the club face is 'open' i.e. its outermost face tip is back from the centre of the club then the ball will be struck to the right (for right-handed golfers) whereas if the club face is 'shut' in the opposite sense the ball will depart to left. In other words, the ball will depart square to the face of the club. Thus in a golf stroke where the ball goes two hundred yards, the ball will go to right or left by about three yards per degree of the club face being open or shut respectively. Since the practical accuracy limits for golf shots should be about:

Not more than twenty yards off line at 200 yards

Not more than ten yards off line at 100 yards this establishes a maximum permissible angle of club face variation as to ten parts in one hundred or 6 parts in 60 i.e. 6 degrees. For pragmatical reasons due to the curved faces of wooded clubs we suggest working to a limit of 8 degrees.

In FIG. 2 there is shown a triangular arrangement of photo switches in which (2) is a reference photo switch to establish a clock impulse in the following circuitry whilst photo switch (3) establishes the 'open' permissible club face limit and photo switch (4) establishes the 'shut' face permissible club face limit. Thus at the clock moment established by the photo switch (2) the following combinations are relevant:

1. If both photo switches are in the illuminated state then the club face is open.
2. If both photo switches are in the darkened state then the club face is shut.
3. If the photo switch (4) is darkened but the photo switch (3) is illuminated then the club face is within permissible limits.

The limits are set at 8 degrees or thereabouts by the triangular geometry shown in FIG. 2.

But it is the purpose of this system to be able to give reasonably accurate decisions irrespective of where the club face is normal to the line of strike and as described under the section on slicing and hooking. However, this is difficult as to the open-shut face determination for two reasons:

1. Wooden clubs have bulging faces and thus if the open-shut triangulation of photo switches is assymetric to the club head centre line, then this can create spurious results.
2. In the event of the ball being impacted well off centrality as to toe or heel strikes then the photo switches can relate to club shadows which involve zones off the main striking face and as shown at (96) and (97) of FIG. 2.

For such reasons it is desirable to triplicate the triangulated system so that one system refers to normal impact as shown in FIG. 2 and involving photo switches (2), (3) and (4) whilst a second system refers to toe impacts and desirably involving photo switches (5*a*), (6*a*) and (7*a*) whilst there is desirably a third system referring to heel impacts involving photo switches (5*b*), (6*b*) and (7*b*). The choice of which system to be decisive can be logically related to the previous section relating to where the club impacts the ball as to normal, toe or heel.

Referring to FIG. 4:

Photo switches (3) and (4) come into flip-flops (98) which are set by a latch in the bank (38) from the photo switch (2). The outputs of (98) are logically processed at (99) to give two alternative inputs into a further logical system (100) as to open or shut. If the situation is normal, neither open nor shut, there are no inputs into (100).

There is identical processing as between photo switches (5*a*), (6*a*) and (7*a*) resulting in the presentation of open-shut data to (103).

There is identical processing as between photo switches (5*b*), (6*b*) and (7*b*) resulting in the presentation of open-shut data to (106).

Thus, three alternative decisions are presented into the logical systems (100), (103) and (106) which may agree with each other or which may be different.

A 2-OR Gate (107) integrates the 'heel fault' information coming from the ball centrality system and this activates the logical system (106) as a 3-AND gate and thus choses the triangulation of photo switches (5*b*), (6*b*), (7*b*) to the system to take the open-shut decision.

Alternatively an 2-OR gate (108 does an equivalent 'toe' selection operation as to photo switches (5*a*), (6*a*) and (7*a*) to be responsible for the correct open-shut decision.

There is a 2-NOR gate (109) whose output is only active if the inputs relate to 'neither toe nor heel but central' and this is permissive into logical system (100) so that photo switches (2), (3) and (4) take the open-shut decision.

All the three outputs from (100), (103) and (106) as to open-shut decisions are taken into the two 3-OR gates (110) and (111) the former collecting all shut decisions (only one of which will be active) and the latter collecting all open decisions (only one of which will be active). The output of these two 3-OR gates are taken via open collector inverters to light the LED lamps (112) or (113) as to the final shut or open decision.

The overall effect is that, of the three possible triangulated photo switch systems which could decide as to open or shut, that one has been selected which is nearest to the centre of the club face although such club face may itself be off-centre as to a true and correct central line of strike.

The corresponding display is shown on FIG. 3.

Yardage Penalty for any Fault

As earlier described the indicated numerical yardage is otherwise independant of the faults which can be incurred related to slice-hook, ball off centrality or open-shut club face. But in practice it is well established in the golfing art that such faults do impose a penalty on the yardage achieved by the golf ball after striking. Thus it has been found desirable to impose an automatic penalty on the displayed ball yardage for any of the main faults described and specifically.

1. There is a slice which exceeds a set limit and is responsible for lighting the lamp (74)
2. There is a hook which exceeds a set limit and is responsible for lighting the lamp (75)
3. The ball is hit off the toe and lights the lamp (92)
4. The ball is hit off the heel and lights the lamp (95)
5. The club face is shut and lights the lamp (112)
6. The club face is open and lights the red lamp (113)

Referring to FIG. 4:

Each of the above factors prior to the open collector inverter (73) is taken to a 6-OR gate (114) whose output is thus giving a logical '1' signal stating 'a fault'.

The normal means of stopping the yardage register (49) is by tapping the two end points of its sixteen digits at the binary numbers 32768 and 16384 and 'adding' these in the 2-AND gate (51) so that the output is active on the register number 32768 + 16384 = 49152.

It is the purpose to penalise faults by creating a lower stop number in the register and this is done at the 2-AND gate (115) which has one input from the number 32768 from the register (49) and the output of the 6-OR gate (114). The effect of this is that since the number 32768 is registered earlier than the number 49152 then the 2-NOR gate (52) is also earlier activated and stops the register via the clock gate (48). This means that the yardage count is reduced in the relationship of 32768/49152 or by about 33 percent (one third exactly).

This fact will be automatically registered by the actual reduced displayed yardage but in addition the output of the gate (115) is taken via the open collector inverter (73) to illuminate a LED lamp (116) declaring PENALTY-33% OFF. Also the output of the gate (51) is taken via the open collector inverter (73) to a lamp (117) which declares NO FAULTS.

Resetting

After the golfer has driven through the system and has observed the display the system has to be reset for a further stroke. This is initiated by the operation of photo switch (34) which is so located to the right of the golfer that the shadow of the club shaft will fall on it about two feet after the commencement of the backswing (FIG. 1—154). The main projector lamp is used to create a light beam for such shadow and this is done by a mirror in the lamp house which reflects light as a filament image through the same projector lens but at an angle to the main beam.

Referring to FIG. 4, on the above action the photo switch (34) goes dark and passes to a 2-AND gate (118) whose other input is at a logical '1' and so triggers a short interval timer (119) to give about a millisecond pulse which serves the general reset line (120) and resets all latches, flip-flops, and other units requiring a reset pulse.

The timer (117) operates a 20 second (approximately) second timer (121) which feeds back to the input gate (118) and thus prevents any further triggering from (34) photo switch passing through the 2-AND gate (118). This inhibition is necessary, since after a strike the trainees and club could casually create a second shadow over the reset cell (34) and thus destroy the displayed information. The output from the 20 second timer (121) is taken forwards through the 2-AND gate (123) to energise a relay (124) which switches on the positive voltage line (125) to give power to all lamps and displays. After the 20-second period has elapsed this voltage is suppressed at the relay (124) and the illuminated display is extinguished. At the same time as the latter, other contacts on the relay light the lamp (126) which carries a legend such as GO and thus indicates that the system is ready for a further golf swing. This same moment marks the de-inhibition of the 2-AND gate (118) so that the system can be again reset in the backswing.

The output of the reset timer (119) at the original time of its actuation, also sets a 3-second timer (122) which is inhibiting on the 2-AND gate (123) and this prevents the signal from the 20-second timer (121) passing through to the relay (124) for an initial period of three seconds. The reason for this is that at the reset on the backswing, the relay would provide power to the display and the display would be of a meaningless but distracting nature to the golfer i.e. lamps would be flashing during his swing. Thus the timer (122) inhibits the display for about three seconds which is longer than the average total swing time and the display is only illuminated some time after impact with the ball and is then the correct and final display.

For teaching purposes it may be desirable to hold the display for longer than the twenty second period controlled by the timer (121) and a switch (127) can intervene to ensure that the power supply (125) to the illuminated displays is maintained.

Alternative Ball Positions

To derive maximum accuracy from the system, the ball must be teed up to a positional accuracy of within 0.10 inch. Since the system takes information from the shadow of the clubhead tip as to ball centrality and slice-hook, then the system must be arranged that the ball is teed centrally after making allowances for the differences between the club face centre and the tip location for various club types. This distance can vary between 1.6 inches and 1.9 inches according to the club used. This problem is overcome by marking the strike mat at the ball teeing position with a row of dots of different colours and spaced normal to the strike direction and at distance of 0.10 inches apart. A separate and loose hollow set square is used to place the club head within it so that the toe is touching a vertical ordinate, then sighting onto the horizontal ordinate where a corresponding set of coloured dots are marked. The golfer then judges which colour dot is closest to the club centre line and uses the corresponding coloured dot on the strike mat for the teeing of his ball. The preferred type of tee to be used is the plastic pyramid variety with a central top hole through which can be sighted such coloured spots. Alternatively, a row of tee holes can be made opposite the coloured dots and a conventional peg tee inserted.

Alternative Technique for Open-Shut Club Disposition

Figure 5:
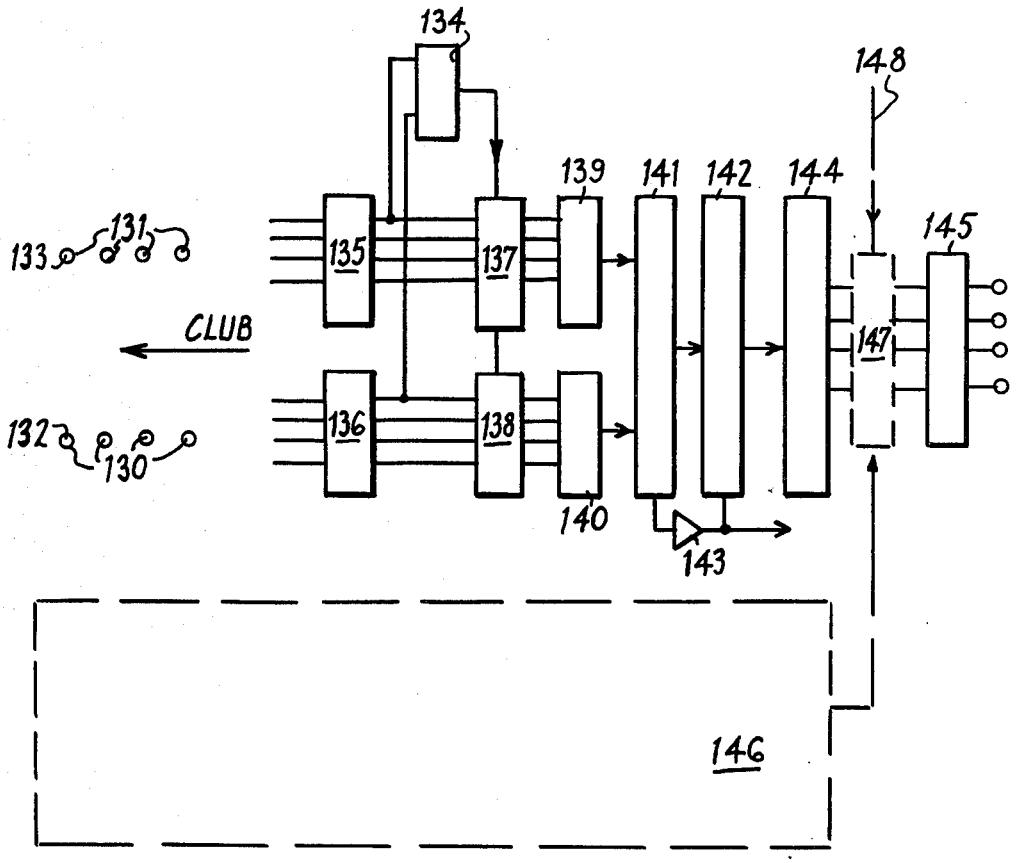

An alternative technique for determining whether the club face is normal open or shut at impact is shown in FIG. 5. There are two arrays of photo switches (130) and (131) arranged either side of the club head centre line and each array is along the line of strike direction. The cells are spaced apart by for example 1/20th inch with the two arrays 1 inch apart. Thus a misalignment of one cell, between two cells in opposing arrays represents $60 \times 1/20 = 3$ degrees. A two cell misalignment would be 6 degrees and so forth.

The extreme downstream photo switches are (132) and (133) and these are taken to a 2-OR gate (134) via latch banks (135) and (136). The photo switches in array C (130) and in array D (131) are taken to latches (135) and then to flip flop banks (137) and (138). The effect of the passing club shadow is to darken either photo switch (132) or (133) first and this operates the OR-gate (134) which sets all the flip-flops at such moment. Thus we have a register of darkened and illuminated photo switches in the two flip flop registers (137) and (138).

The outputs of the flip flop registers are then encoded into BCD at (139) and (140) and the outputs subtracted in arithmatic units (141) and (142), the final output being the subtraction number in BCD together with a sign signal from (143). The circuits are generally the same as those already described for hook-slice determination.

The BCD number is converted to a series of discrete outputs from a priority decoder (144) which go forwards through an open collector inverter (145) to light one of a series of display lamps representing the scale of angular open-shut such as 3, 6, 9 etc. degrees corresponding to the shadow assymetry across the two arrays C and D. The signal from the sign device (143) is used both directly and via an inverter to operate a logic gate system similar to (71) and (72) of the hook-slice system to display whether the degree lamps relate to an open or shut club face.

The system can be duplicated (146) or triplicated etc. as with the alternative triangulated method described earlier and with such alternative outputs going to a logical system (147) and controlled by signals (148) coming from the ball-centrality system and thus chosing the preferred arrays which are nearest to club centrality. Such a system can be further refined by the use of more photo switches in the arrays and at closer spacings and giving a digital readout as to degrees of open or shut face and using the same technique already described for digital readout for the hook-slice system.

The Teaching Use of the System

Experience with the use of the system described shows that the variations between successive swings of a golfer are such that his central consistency or characteristic can only be evaluated on a statistical basis. Typically it has been found that averaging the results over ten swings gives important and characteristic information but that the golfer must not be able to see the display after a given swing otherwise he makes instinctive corrections. It has been found desirable to mask the display in such a way that only his teacher, such as a golf professional, can see the display and record the swing characteristic over a number of swings before coming to an analytical decision as to the correctness or otherwise of the golfers style. This is most conveniently done by arranging that the display (FIG. 1—155) can hinge about its vertical axis so that the display can be turned away from the golfer and towards the observing teacher. This arrangement can be actualised in a number of ways but is particularly simple when the main stand consists of a single round tube to define such vertical axis.

It will be apparent that the invention has been described only by way of example and that various modifications may be made to the specific details referred to, without in any way departing from its scope.

What I claim is:

1. Golf training apparatus comprising:

A. a base member having an impact area over which a golfer may swing a golf club to strike a target ball carried in the impact area;

B. a light source arranged to direct light onto the impact area to cause a shadow of the golf club head to fall on the impact area as the club swings across the area;

C. a plurality of photoelectric cells distributed in said area so as to receive light from said light source and which may be shadowed momentarily during the passage of the club across the impact area; and D. signal processing means for correlating signals received from the photocells during the passage of the golf club over the impact area to provide data relating to an impact of the club on the target ball, and wherein said photocells include first and second photocells located in the path of the club as it swings to pass over the impact area; and wherein said processing means includes (e) a counter;

(f) a variable frequency clock; pulse generator;

(g) a gate which is enabled when the club passes over said first photocell to allow pulses from said generator to pass to said counter, and which is blocked when the club passes over said second photocell, whereby the number of pulses counted is representative of the speed of the club head prior to impact, and (h) means for varying the frequency of the pulses generated by said generator to compensate for variations in the type of club employed, or for variations between individual clubs of the same type, the frequency of the clock pulse generator being such that at least one hundred pulses are passed through said gate during a single club swing.

2. Golf training apparatus according to claim 1 and further including means operative to determine the degree of squareness with which the golf club impacts on a ball in the target area, said means comprising a first set of photocells, said set of photocells comprising:

(a) a reference photocell operative to give a clock pulse on the passage of a club head thereover, (b) an "open" photocell, and (c) a "shut" photocell, the three photocells being arranged in an acute triangle with said reference photocell at the apex of the triangle.

3. Golf training apparatus as claimed in claim 2, wherein said reference, open and shut photocells are connected to said signal processing means which is responsive to a clock pulse from said reference photocell for providing an indication of:

(a) an open club face if said open and shut photocells are in the illuminated state;

(b) a shut club face if said open and shut photocells are in the darkened state;

(c) a club face within permissible limits if said shut photocell is darkened and said open photocell is illuminated.

4. Golf training apparatus as claimed in claim 3, and further comprising:

three sets of reference, open and shut photocells respectively, and wherein said signal processing means includes means operative to select one of said sets in accordance with whether the club head impacts the ball either centrally, or towards either the toe or the heel of the club.

5. Golf training apparatus as claimed in claim 4, and further comprising:

two parallel arrays of photocells arranged transversely to an ideal path of the club head whereby differences between the outputs of the photocells during the passage of the golf club provide data concerning the actual direction of travel of the golf club.

6. Golf training apparatus as claimed in claim 5, wherein said signal processing means is operative in response to said data from said parallel arrays of photocells to select a particular one of said three sets of references open and shut photocells in accordance with whether the club face would impact the target ball towards either its toe, centrally or towards its heel.

* * * * *

UNITED STATES PATENT AND TRADEMARK OFFICE

CERTIFICATE OF CORRECTION

PATENT NO. : 4,146,230

DATED : March 27, 1979

INVENTOR(S) : David Blythe Foster

It is certified that error appears in the above-identified patent and that said Letters Patent are hereby corrected as shown below:

Column 2, line 2, thereby should be --therein--.

Column 3, line 35, first occurrence "39" should be --38--.

Column 4, line 24, "gold" should be --golf--.

Column 4, line 58, after (clock rate) "32" should be --=--.

Column 4, line 62, "known" should be --know--.

Column 6, line 47, second occurrence of Array "B" should be --A--.

Column 7, line 11, "relates" should be --related--.

Column 8, line 68, second occurrence, "are" should be -- and --.

Column 13, line 25, "arithmatic" should be --arithmetic--.

Signed and Sealed this

*Thirtieth* Day of *October 1979*

[SEAL]

*Attest:*

RUTH C. MASON
*Attesting Officer*

LUTRELLE F. PARKER
*Acting Commissioner of Patents and Trademarks*